US010574010B1

(12) United States Patent
Huang et al.

(10) Patent No.: US 10,574,010 B1
(45) Date of Patent: Feb. 25, 2020

(54) SOCKET CAPABLE OF PULLING OFF PLUG WITH ONE HAND

(71) Applicant: Wei Shiang Huang, Changhua County (TW)

(72) Inventors: Wei Shiang Huang, Changhua County (TW); Fang Chi Tsai, Changhua County (TW)

(73) Assignee: Wei Shiang Huang, Changhua County (TW)

( * ) Notice: Subject to any disclaimer, the term of this patent is extended or adjusted under 35 U.S.C. 154(b) by 0 days.

(21) Appl. No.: 16/369,092

(22) Filed: Mar. 29, 2019

(30) Foreign Application Priority Data

Aug. 20, 2018 (TW) ..... 107128987 A

(51) Int. Cl.

| | |
|---|---|
| ***H01R 35/02*** | (2006.01) |
| ***H01R 13/629*** | (2006.01) |
| ***H01R 13/652*** | (2006.01) |
| ***H01R 24/30*** | (2011.01) |
| ***H01R 4/52*** | (2006.01) |
| ***H01R 13/66*** | (2006.01) |
| ***H01R 4/66*** | (2006.01) |

(52) U.S. Cl.
CPC ..... *H01R 35/02* (2013.01); *H01R 4/52* (2013.01); *H01R 4/66* (2013.01); *H01R 13/629* (2013.01); *H01R 13/652* (2013.01); *H01R 13/66* (2013.01); *H01R 24/30* (2013.01)

(58) Field of Classification Search
CPC ..... H01R 35/02; H01R 24/30; H01R 4/66; H01R 13/66; H01R 13/652; H01R 13/629
See application file for complete search history.

(56) References Cited

U.S. PATENT DOCUMENTS

| | | | | |
|---|---|---|---|---|
| 6,015,307 | A * | 1/2000 | Chiu | H01R 13/71 200/51.09 |
| 8,430,679 | B1 * | 4/2013 | Long | H01R 35/04 439/118 |
| 8,500,492 | B2 * | 8/2013 | Brown | H01R 35/04 439/638 |
| 9,028,274 | B2 * | 5/2015 | Zien | H01R 13/514 439/527 |
| 10,297,967 | B2 * | 5/2019 | Wei | H01R 31/06 |
| 2018/0337503 | A1 * | 11/2018 | Oh | H01R 39/64 |

* cited by examiner

*Primary Examiner* — Briggitte R. Hammond
(74) *Attorney, Agent, or Firm* — Wang Law Firm, Inc.

(57) ABSTRACT

A socket includes a socket base, a first conducting plate, a second conducting plate, a cover, and a conducting assembly. The socket base is provided with a first driving device and a second driving device. The first conducting plate is received in the socket base and connected to the first driving device. The second conducting plate is received in the socket base and connected to the second driving device. The cover is connected to the socket to be turned between a first position and a second position. The conducting assembly has a first clamping member and a second clamping member to received pins of a plug therein. The first clamping member and the second clamping member are connected to the cover, and the first clamping member is associated with the first driving device and the second clamping member is associated with the second driving device.

9 Claims, 9 Drawing Sheets

SOCKET CAPABLE OF PULLING OFF PLUG WITH ONE HAND

BACKGROUND OF THE INVENTION

1. Technical Field

The present invention relates generally to an electrical device, and more particularly to a socket which allows user to plug and unplug with one hand.

2. Description of Related Art

Typically, a conventional socket includes pin receptacles, into which pins of a plug are inserted. The pin receptacles hold the pins of the plug and conduct electricity. The conventional pin receptacles are made of a bent metallic plate. The bent metallic plate is flexible to clamp the pin. However, user has to exert the plug with a predetermined strength to pull off the plug.

Extensional cords are the common electrical device for connection of power. If a user wants to pull off a plug which is fitted into the socket of the extension cord, he/she has to hold the socket with one hand and pull the plug with the other hand. Some people step on the socket of the extension cord with foot and hold the wire of the plug to pull off the plug. It will cause the wire of the plug broken.

BRIEF SUMMARY OF THE INVENTION

In view of the above, the primary objective of the present invention is to provide a socket, which hold the plug tight when conducting electricity and loose the plug when there is no electricity to allow user to pull off the plug with one hand.

In order to achieve the objective of the present invention, a socket includes a socket base provided with a first driving device and a second driving device; a first conducting plate received in the socket base and connected to the first driving device; a second confucting plate received in the socket base and connected to the second driving device; a cover connnected to the socket to be turned between a first position and a second position, wherein the cover has a plurality of aperture; and a conducting assembly having a first clamping member and a second clamping member to received pins of a plug therein, wherein the first clamping member and the second clamping member are connected to the cover, and the first claiming member is associated wit the first driving device and the second clamping member is associated with the second driving device.

The first clamping member is moved away from the first driving device and the second clamping member is moved away from the second driving device when the cover is turned to the first position, so that the pins of the plug are lookse and the first clamping member and the second clamping member do not conduct the first conducting plate and the second conducting plate, respectively. The first clamping member is pressed by the first driving device and the second clamping member is pressed by the second driving device when the cover is turned to the second position, so that the pins of the plug are clamped by the first clamping member and the second clamping member and the first clamping member and the second clamping member conduct the first conducting plate and the second conducting plate, respectively.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
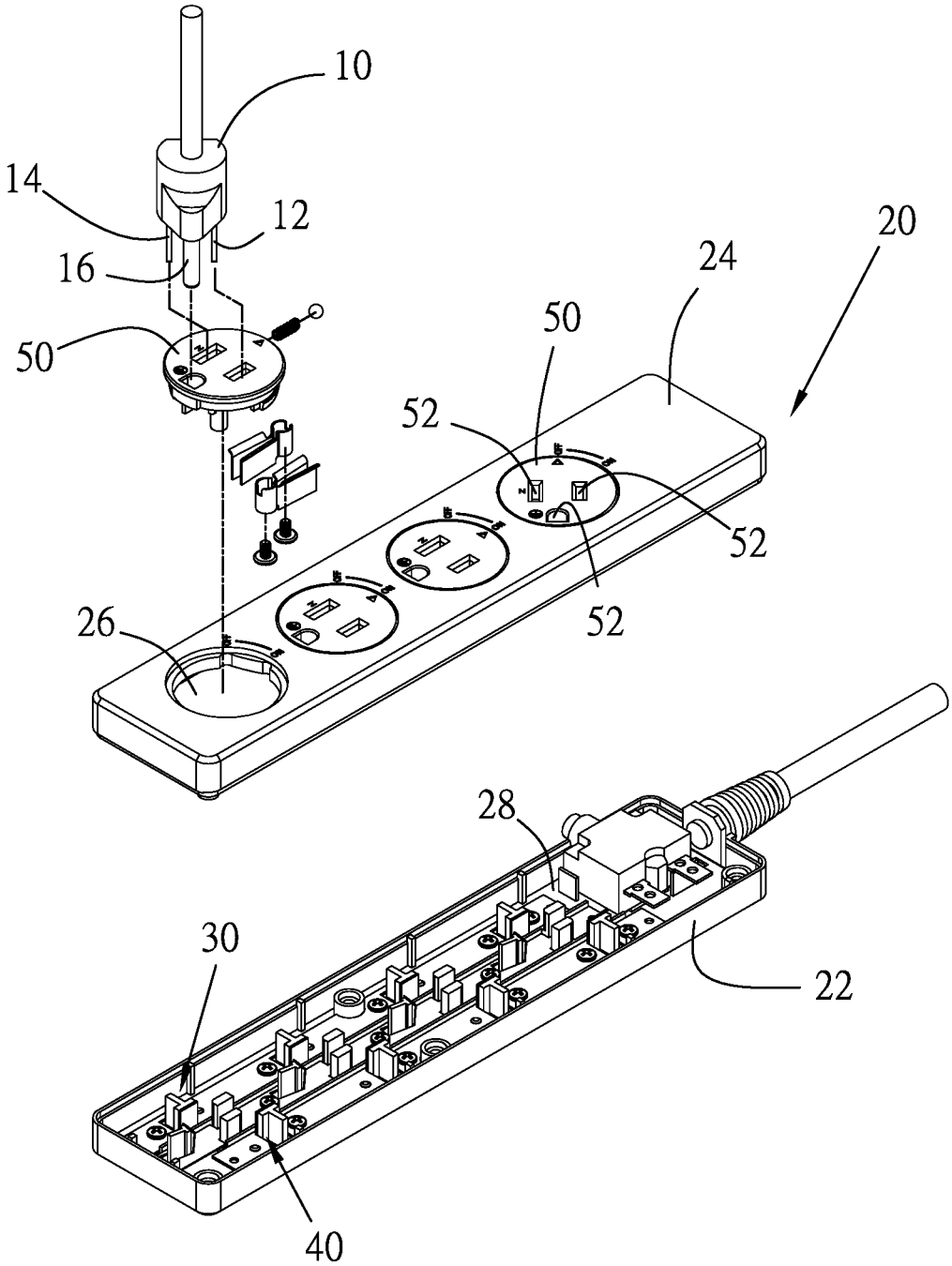
FIG. 1 is an exploded view of a preferred embodiment of the present invention.

As shown in FIG. 1, a socket of the preferred embodiment of the present invention includes a socket base 20 to fit a plug 10. The plug 10 has three pins 12, 14, 16. The socket 20 is provided with four covers 50, each of which has three apertures 52 for passing the pins 12, 14, 16. One of the pins 16 is a grounding pin.

The socket base 20 has a first case 22 and a second case 24. The second case 24 is connected to the first case 22 to have a room 28 therebetween. The second case 24 has four bores 26 for receiving the covers 50, and the covers 50 are free to rotate. Four pairs of first driving devices 30 and second driving devices 40 are provided in the room 28 of the socket base 20 and located under the covers 50 respectively.

Figure 2:
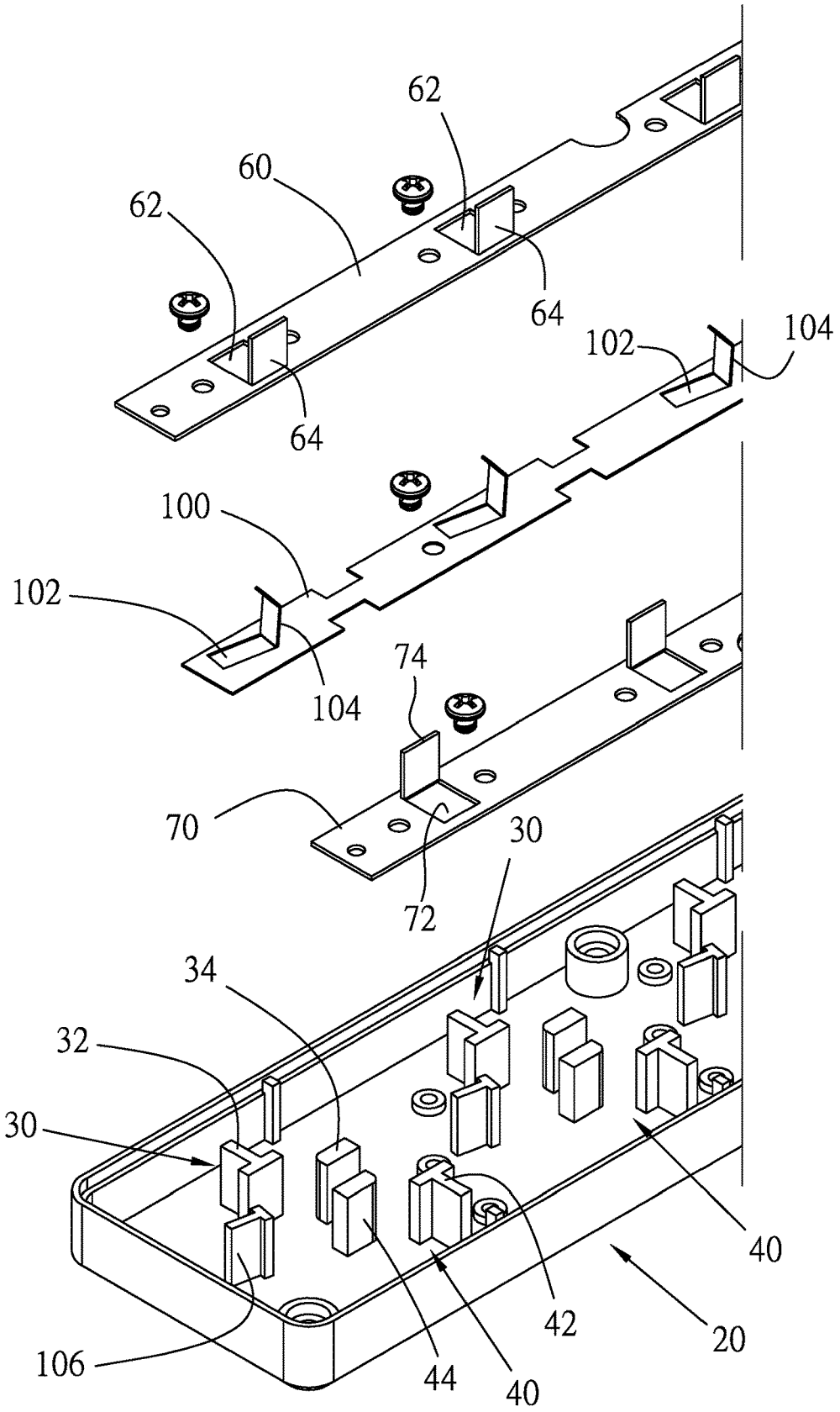
FIG. 2 is an exploded view of the preferred embodiment of the present invention, showing the first conducting plate, the second conducting plate, and the grounding plate.

As shown in FIG. 2, each of the first driving devices 30 has a first holding post 32 and a first clamping post 34. The first clamping post 34 is kept a predetermined distance from the first holding post 32. Each of the second driving devices 40 has a second holding post 42 and a second clamping post 44. The second clamping post 44 is kept a predetermined distance from the second holding post 42.

A first conducting plate 60 is connected to the first driving devices 30, and a second conducting plate 70 is connected to the second driving devices 40. The first conducting plate 60 has four openings 62 and four conducting portions 64 beside the openings 62. The second conducting plate 70 has four openings 72 and four conducting portions 74 beside the openings 72. The first and the second conducting portions 64, 74 are bent portions of the first and the second conducting plate 60, 70, which form the openings 62, 72 when they are bent. The first and the second conducting plate 60, 70 are connected to a power source (not shown) through wires of the socket.

Figure 3:
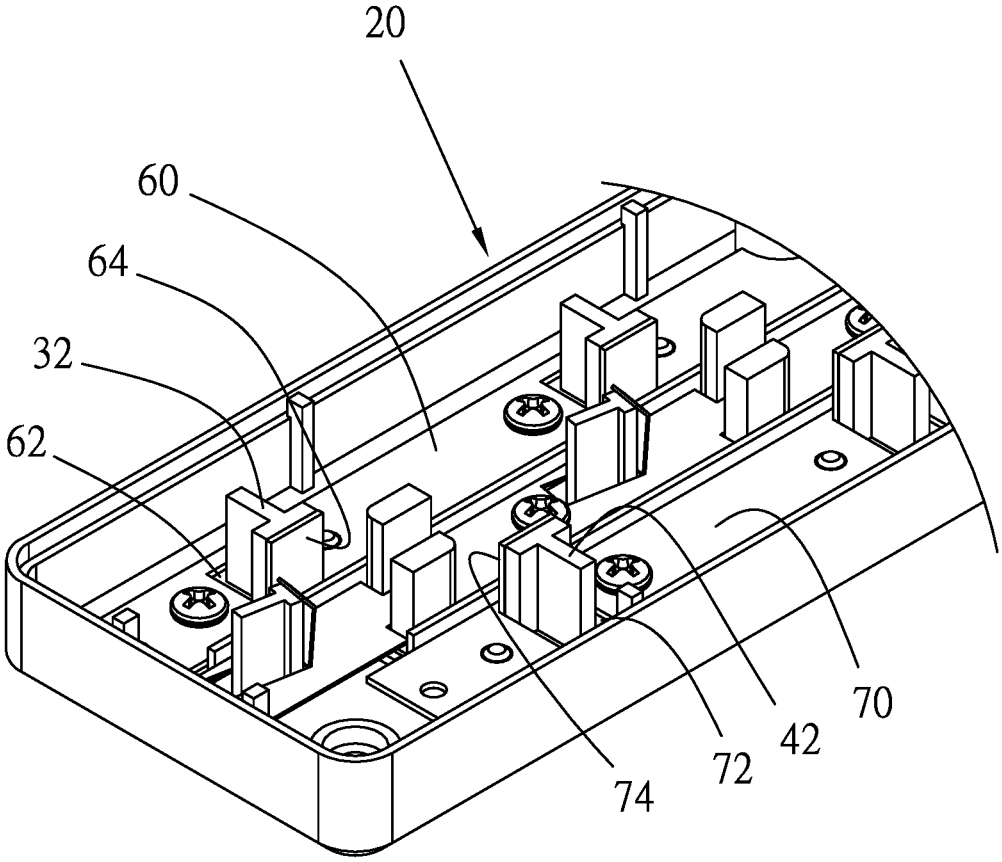
FIG. 3 is a perspective view of the preferred embodiment of the present invention, showing the first conducting plate, the second conducting plate, and the grounding plate.

As shown in FIG. 3, the first conducting plate 60 is mounted in the socket base 20 with the first holding posts 32 of the first driving devices 30 passing through the openings 62 of the first conducting plate 60 and the conducting portions 64 associated with the first holding posts 32, respectively. The second conducting plate 70 is mounted in the socket base 20 with the second holding posts 42 of the second driving devices 40 passing through the openings 72 of the second conducting plate 70 and the conducting portions 74 associated with the second holding posts 42, respectively.

Figure 4:
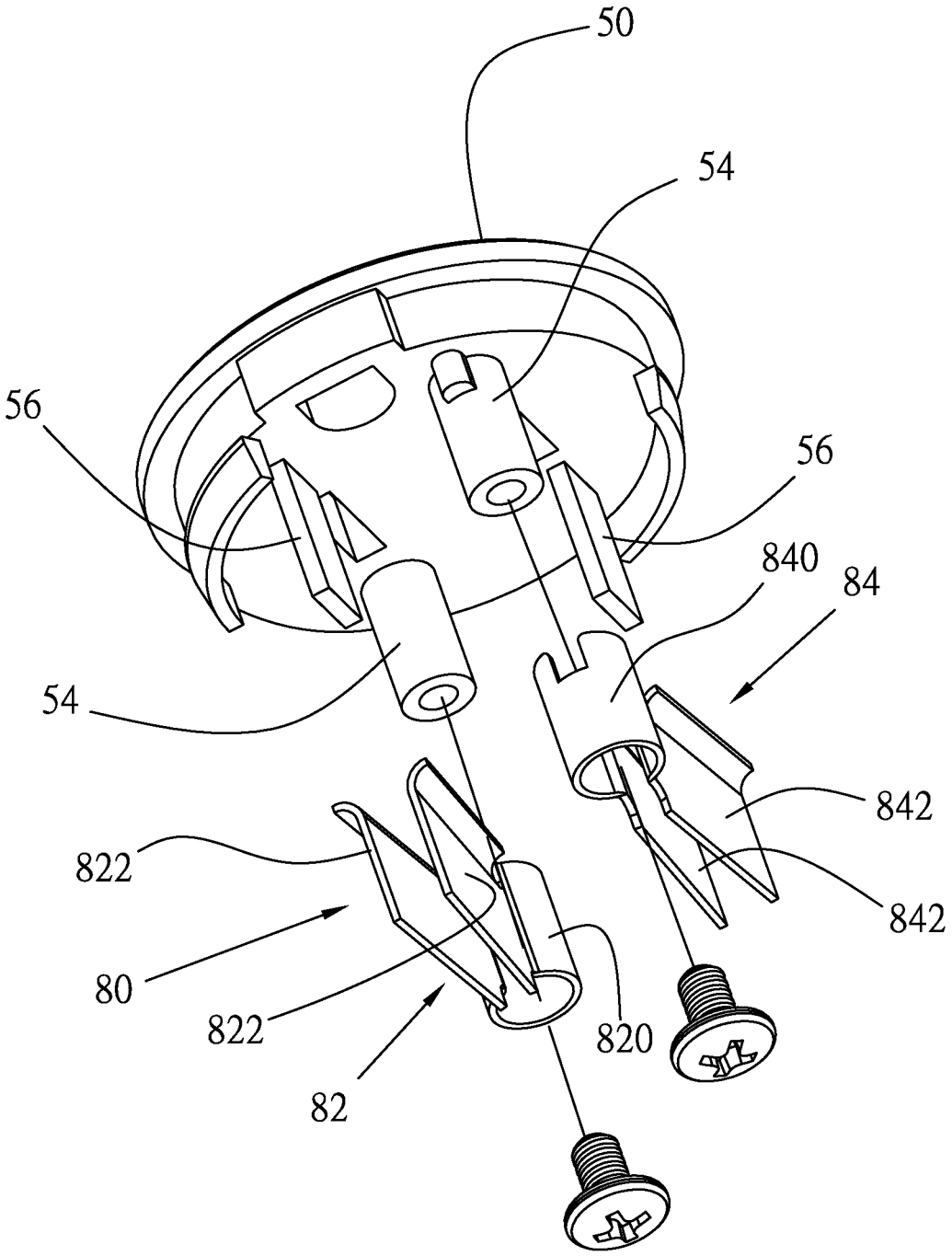
FIG. 4 is an exploded view of the preferred embodiment of the present invention, showing the socket cover, the first pin receptacle, and the second pin receptacle.
Figure 5:
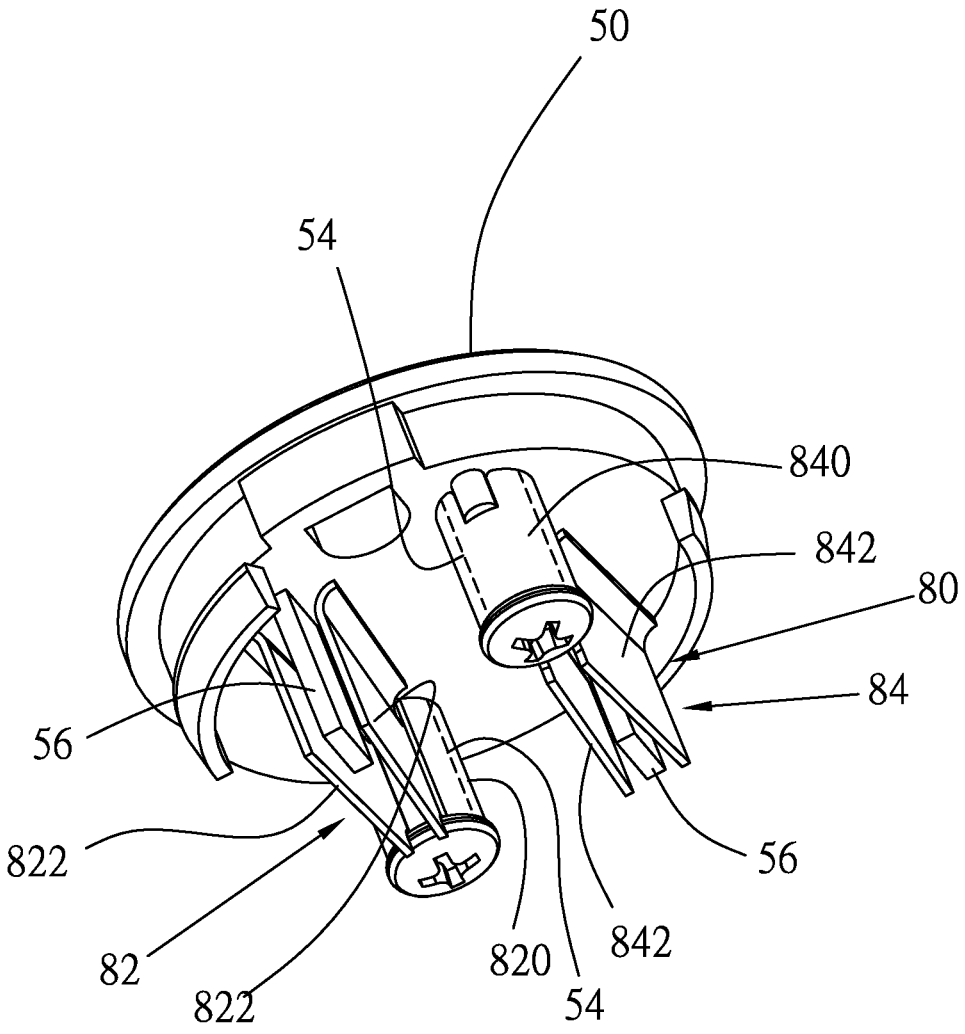
FIG. 5 is a perspective view of the preferred embodiment of the present invention, showing the socket cover, the first pin receptacle, and the second pin receptacle.

As shown in FIG. 4 and FIG. 5, each of the covers 50 has two connecting members 54 and two spacing members 56 on a bottom side thereof. In the present preferred embodiment, four conducting assemblies 80 are connected to the covers 50, each of which has a first clamping member 82 and a second clamping member 84.

The first clamping member 82 has two first arms 822 and a first axial portion 820. The first arms 822 are projected from the first axial portion 820. The first arms 822 are flexible to be bent to enlarge a distance therebetween.

The second clamping member 84 has two second arms 842 and a second axial portion 840. The second arms 842 are projected from the second axial portion 840. The second arms 842 are flexible to be bent to enlarge a distance therebetween.

The connecting members 54 of the cover 50 are connected to the first axial portion 820 of the first clamping member 82 and the second axial portion 840 of the second clamping member 84 to fix the first clamping member 82 and the second clamping member 84 to the bottom side of the cover 50. The spacing members 56 are located between the first and the second arms 822, 842 of the first and the second clamping member 82, 84, respectively.

Figure 6:
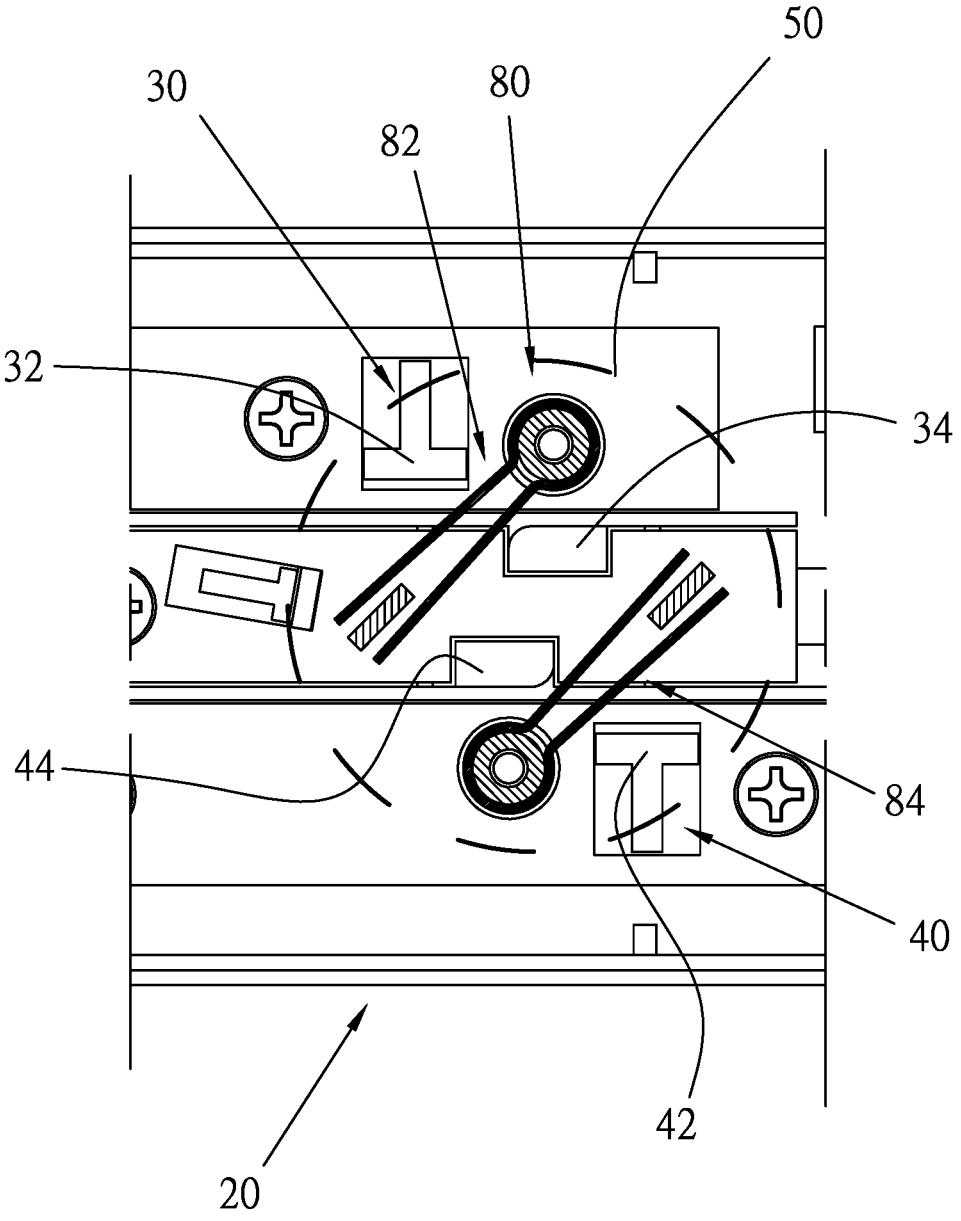
FIG. 6 is a sketch diagram of he preferred embodiment of the present invention, showing the condition of without power.

As shown in FIG. 6, the cover 50 is connected to the socket base 20 with the conducting assembly 80 received in the room 28 of the socket base 20. The first clamping member 82 is associated with the first driving device 30, and the second clamping member 84 is associated with the second driving device 40. Precisely, the first clamping member 82 is between the first holding post 32 and the first clamping post 34, and the second clamping member 84 is between the second holding post 42 and the second clamping post 44.

Figure 7:
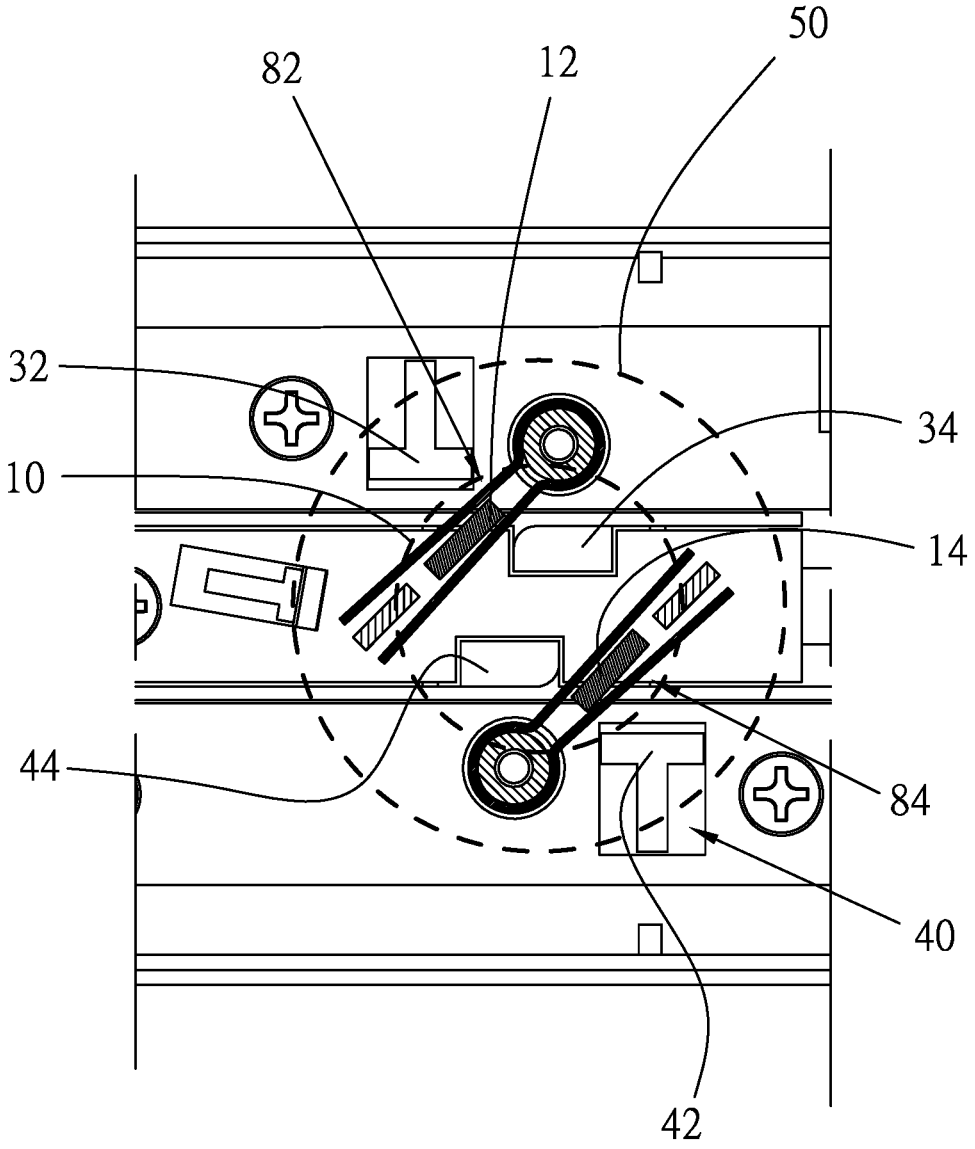
FIG. 7 is a sketch diagram of he preferred embodiment of the present invention, showing the condition of without power and the pins being inserted.

FIG. 7 shows that the plug 10 is inserted into the cover 50 with the pin 12 received in a space between the first arms 822 of the first clamping member 82 and the pin 14 received in a space between the second arms 822 of the second clamping member 84, respectively. When the cover 50 is turned to a first position, the pins 12, 14 do not contact with the first and the second clamping members 82, 84. In other words, the pin 12 is kept a predetermined distance from the first arms 822 of the first clamping member 82 and the pin 14 is kept a predetermined distance from the second arms 842 of the second clamping member 84, respectively. Therefore, the pins 12, 14 are easy to be inserted into or pulled off.

Figure 8:
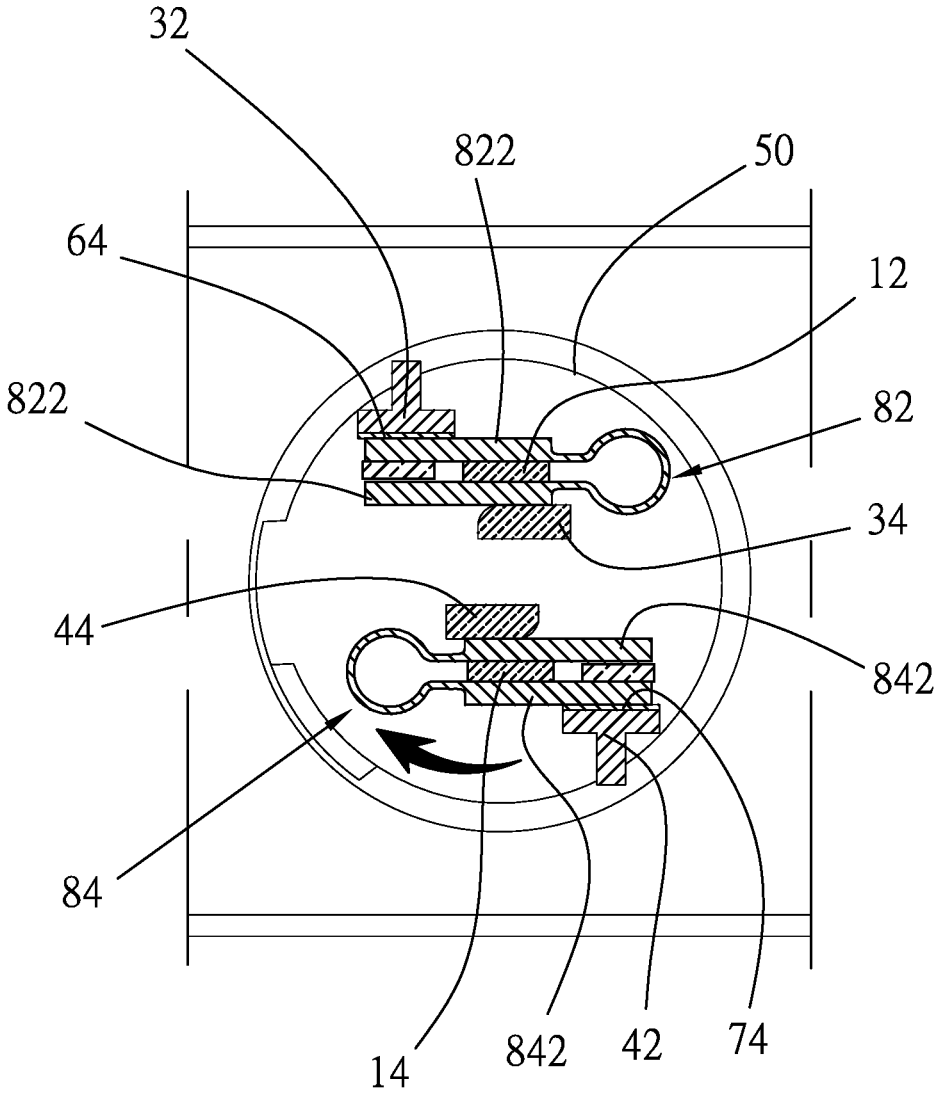
FIG. 8 is a sketch diagram of he preferred embodiment of the present invention, showing the condition of with power.

As shown in FIG. 8, when the plug 10 is inserted and then the cover 50 is rotated to a second position, the first arms 822 of the first clamping member 82 are pressed by the first holding posts 32 and first clamping post 34, so that the first arms 822 are bent inwardly to clamp the pin 12. Meanwhile, the first arm 822 also contacts with the conducting portion 64 of the first conducting plate 60, which is rested on the first clamping post 34. The same as the first clamping member 82, the second arms 842 of the second clamping member 84 are bent inwardly by the second holding posts 42 and the second clamping post 44 to clamp the pin 12, and the second arm 842 contacts with the conducting portion 74 of the second conducting plate 70. As a result, electricity is conducted to the pins 12, 14 through the first and the second conducting plate 60, 70, the conducting portions 64, 74, and the first and the second clamping members 82, 84. Also, the pins 12, 14 are clamped by the first and the second clamping members 82, 84, so that the plug 10 is hard to be pulled off. The spacing members 56 move the first and the second arms 822, 842 when the cover 50 is being turned and reduce a risk of the first and the second arms 822, 842 being deformed.

Figure 9:
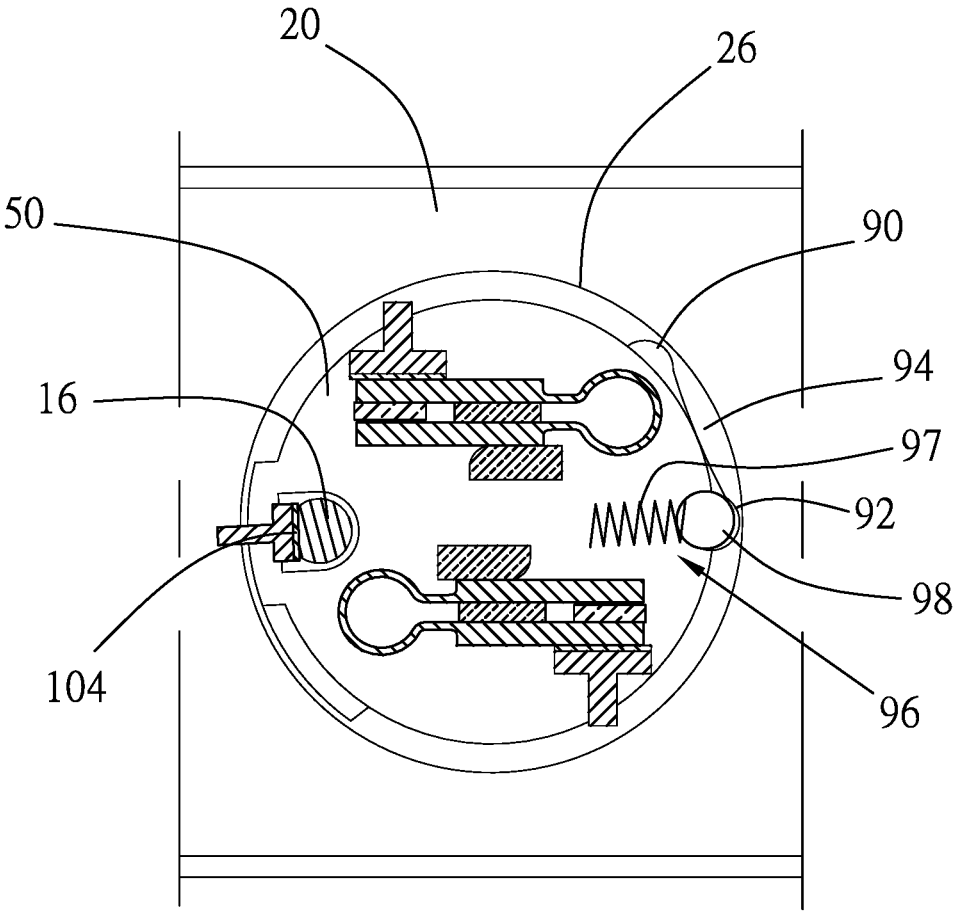
FIG. 9 is a sketch diagram of he preferred embodiment of the present invention, showing the condition of with power and the grounding pin contacting the grounding terminal.

In conclusion, the present invention provide the cover 50 to be turned for holding the pins 12, 14 and conducting electricity to the plug 10 when the cover is turned to the second position, and cut the power off and loose the pins 12, 14 when the cover 50 is turned to the second position. Therefore, the plug 10 is hard to be pulled off when power is on, and the plug 10 is easy to be fitted into and pulled off when power is off As shown in FIG. 9, the socket base 20 is provided with a first positioning recess 90 and a second positioning recess 92 on a sidewall of the bore 26 and a guiding portion 94 between the first and the second positioning recesses 90, 92. The guiding portion 94 is a convex portion on the sidewall of the bore 26 with opposite ends connected to the first and the second positioning recesses 90, 92. A positioning device 96, which includes a spring 97 and a ball 98, is connected to the cover 50 to have the ball 98 moved between the first and the second positioning recesses 90, 92 through the guiding portion 94 when the cover 50 is turned between the first position and the second position.

As shown in FIG. 2, a grounding plate 100 is received in the socket base 20, and the socket base 20 is provided with a plurality of grounding posts 106. The grounding plate 100 is provided with a plurality of openings 102 and grounding portions 104 next to the openings 102 respectively. The grounding posts 106 pass through the openings 102 and are attached to grounding portions 104 respectively when the grounding plate 100 is mounted in the socket base 20. The grounding posts 106 are designated to rest against the grounding pin 16 and the grounding plate 100 conducts the grounding pin 16 through the grounding portions 104.

In conclusion, the cover is able to be turned between the first position and the second position. In the first position, the arms of the first and the second clamping members are opened and the power is disconnected to the clamping members, so that the plug is easy to be plugged and unplugged. In the second position, the arms of the first and the second clamping members are exerted by the holding posts and the clamping posts to move inwards and clamp the pins, so that the pins are hard to be pulled off. The positioning device is moved between the first and the second recesses through the guiding portion when the cover is turned between the first position and the second position. in addition, the socket shown in the present embodiment is an extension cord. However, any type of socket, such as fixed socket on the wall, may be use the structure of the present invention.

It must be pointed out that the embodiments described above are only some preferred embodiments of the present invention. All equivalent structures which employ the concepts disclosed in this specification and the appended claims should fall within the scope of the present invention.

What is claimed is:

1. A socket, comprising:

a socket base provided with a first driving device and a second driving device;

a first conducting plate received in the socket base and connected to the first driving device;

a second conducting plate received in the socket base and connected to the second driving device;

a cover connected to the socket to be turned between a first position and a second position, wherein the cover has a plurality of aperture; and a conducting assembly having a first clamping member and a second clamping member to receive pins of a plug therein, wherein the first clamping member and the second clamping member are connected to the cover, and the first clamping member is associated with the first driving device and the second clamping member is associated with the second driving device;

wherein the first clamping member is moved away from the first driving device and the second clamping member is moved away from the second driving device when the cover is turned to the first position, so that the pins of the plug are loose and the first clamping member and the second clamping member do not conduct the first conducting plate and the second conducting plate, respectively; the first clamping member is pressed by the first driving device and the second clamping member is pressed by the second driving device when the cover is turned to the second position, so that the pins of the plug are clamped by the first clamping member and the second clamping member and the first clamping member and the second clamping member conduct the first conducting plate and the second conducting plate, respectively.

2. The socket of claim 1, wherein the first driving device includes a first holding post and a first clamping post fixed in the socket base; the first holding post is kept a predetermined distance from the first clamping post; the first conducting plate has an opening and a conducting portion; the first holding post of the first driving device passes through the opening of the first conducting plate, and the conducting portion of the first conducting plate is rested on the first holding post; the first holding post and the first clamping post of the first driving device press opposite sides of the first clamping member and the first clamping member conducts the conducting portion of the first conducting plate when the cover is moved to the second position.

3. The socket of claim 1, wherein the second driving device includes a second holding post and a second clamping post fixed in the socket base;

the second holding post is kept a predetermined distance from the second clamping post; the second conducting plate has an opening and a conducting portion; the second holding post of the second driving device passes through the opening of the second conducting plate, and the conducting portion of the second conducting plate is rested on the second holding post; the second holding post and the second clamping post of the second driving device press opposite sides of the second clamping member and the second clamping member conducts the conducting portion of the second conducting plate when the cover is moved to the second position.

4. The socket of claim 1, wherein the cover has two connecting members, to which the first clamping member and the second clamping member are connected respectively.

5. The socket of claim 1, wherein the first clamping member has two first arms, and the second clamping member has two second arms; the first arms and the second arms are flexible; the first arms are pressed by the first driving device while the second arms are pressed by the second driving device when the cover is turned to the second position; the cover has two spacing members received in spaces between the first arms of the first clamping member and the second arms of the second clamping member respectively.

6. The socket of claim 1, further comprising a positioning device connected to the cover to be moved between a first positioning recess and a second positioning recess when the cover is turned to the first position and the second position, wherein the socket base has a bore, in which the cover is received; the first positioning recess, the second positioning recess, and the guiding portion are provided on a sidewall of the bore of the socket base.

7. The socket of claim 6, wherein the positioning device has a spring and a ball; the spring urges the ball, and the ball is received in the first positioning recess and the second positioning recess when the cover is turned to the first position and the second position.

8. The socket of claim 7, wherein the socket base further is provided with a guiding portion on the sidewall of the bore; the guiding portion has opposite ends connected to the first positioning recess and the second positioning recess; the ball moves on the guiding portion when the cover is turned to the first position and the second position.

9. The socket of claim 1, further comprising a grounding plate, which is received in the socket base, having an opening and a grounding portion, wherein the socket base is provided with a grounding post, and the grounding post passes through the opening of the grounding plate; the grounding portion is rested on the grounding post.

* * * * *